US005775151A

United States Patent [19]

Massée

[11] Patent Number: 5,775,151

[45] Date of Patent: Jul. 7, 1998

[54] METHOD AND APPARATUS FOR SPINNING A METAL SHEET

[76] Inventor: Johan Massée, Vijfsprongweg 104, 6741 JC Lunteren, Netherlands

[21] Appl. No.: 683,341

[22] Filed: Jul. 18, 1996

[30] Foreign Application Priority Data

Jul. 20, 1995 [NL] Netherlands ..... 1000851

[51] Int. Cl.[6] ..... B21D 22/18

[52] U.S. Cl. ..... 72/10.4; 72/81; 72/83

[58] Field of Search ..... 72/9.5, 10.1, 10.4, 72/13.5, 14.1, 14.4, 17.2, 81, 82, 83, 85

[56] References Cited

U.S. PATENT DOCUMENTS 4,976,126 12/1990 Yamamoto et al. ..... 72/83

FOREIGN PATENT DOCUMENTS 0125720 11/1984 European Pat. Off. .
2927604 1/1981 Germany .
4223510 1/1994 Germany .
58-119425 7/1983 Japan .
59-61529 4/1984 Japan ..... 72/83
60-240337 11/1985 Japan ..... 72/83
1027724 1/1989 Japan .
4322828 11/1992 Japan .
91/17004 11/1991 WIPO .

*Primary Examiner*—Lowell A. Larson
*Attorney, Agent, or Firm*—Westman, Champlin & Kelly, P.A.; S. Koehlee

[57] ABSTRACT

To spin a metal sheet around a chuck for forming a product, in a teaching phase involving force control, a product is formed on the chuck by rotating the chuck about the axis of rotation and by moving a forming roller one or several times alongside the chuck with a pre-determined pressure force thereby spinning the intermediate metal sheet. In the teaching phase, measuring data corresponding to the movement of the forming roller during spinning is fixed in a memory of a control unit, and in the production phase the forming roller is controlled with the aid of these measuring data. The control unit determines the position values of the forming roller in axial direction and in transverse direction relative to the chuck from the data fixed in the teaching phase, and the control unit controls the forming roller in the production phase at least during a part of the spinning movement by means of the position values determined in this manner for spinning the metal sheet into the desired product.

10 Claims, 2 Drawing Sheets

METHOD AND APPARATUS FOR SPINNING A METAL SHEET

BACKGROUND OF THE INVENTION

1. Field of the Invention

The invention relates to a method of spinning a metal sheet around a chuck for forming a product, wherein in a teaching phase by force control, a product is formed on the chuck by rotating the chuck about the axis of rotation and by moving a forming roller one or several times alongside the chuck with a pre-determined pressure force thereby spinning the intermediate metal sheet, and in the teaching phase measuring data corresponding to the movement of the forming roller during spinning is fixed in a memory of a control unit, and in the production phase the forming roller is controlled with the aid of the measuring data.

2. Description of the Related Art

Such a method is known from European patent application 0 125 720 of the same applicant. In this patent application a spinning machine is disclosed in which the forming roller is coupled to a driving member through a spring means having a known spring characteristic in order to displace the forming roller. In this prior art method, the teaching phase involving force control is used to fix position values corresponding to forces exerted by the forming roller, whereafter these position values are used to control the forming roller in the production phase. As a result, the metal sheet will be spun accurately against the chuck with a desired force. Although this prior art method offers good results in practice for most of the products, in particularly the internal dimensions of the product are reproducible in an accurate manner, there are products which should meet high requirements also in respect of external dimension of the product. Such small tolerances for the external dimensions are not ensured in the prior art method involving force control, since, for example, the forming roller will be deflected in case of variations in the thickness of the metal sheet.

SUMMARY OF THE INVENTION

It is the object of the invention to provide a method of the type mentioned in the preamble in which this disadvantage is removed in an effective way.

For this purpose, the method according to the invention is characterized in that the control unit determines the position values of the forming roller in an axial direction and in a transverse direction relative to the chuck from the data fixed in the teaching phase, and the control unit controls the forming roller in the production phase at least during a part of the spinning movement by means of the position values determined in this manner for spinning the metal sheet into the desired product.

As a result, there is obtained a method of spinning a metal sheet in which the measuring data obtained during the teaching phase in which force control is used, delivers position data of the forming roller so that in the production phase the control unit is permitted to affect the spinning operation by position control at least in those parts where the external dimensions of the product should meet tight tolerances.

The invention further provides an apparatus for using the method, comprising a forming roller, an upper slide guided on an upper bed and supporting the forming roller, a first driving member for displacing the upper slide, in which the forming roller is coupled to the first driving member by means of a first spring means, a control unit having a memory and at least two detectors for determining the force exerted on the forming roller during the spinning operation, in which the control unit is adapted to store measuring data of the detectors into the memory during a teaching phase and to control the forming roller during a production phase with the aid of the measuring data stored in the memory, said apparatus, in accordance with the invention, is characterized in that an additional detector is provided which delivers additional measuring data to the control unit, said control unit being adapted to determine position values of the forming roller from the measuring data and additional data stored in the memory and for controlling the forming roller with the aid of the thus determined position values during at least a part of the spinning operation in the production phase.

The invention will now be explained with reference to the drawing showing an embodiment of the apparatus according to the invention by way of example and in a very schematic fashion.

DESCRIPTION OF THE PREFERRED EMBODIMENT

Figure 1:
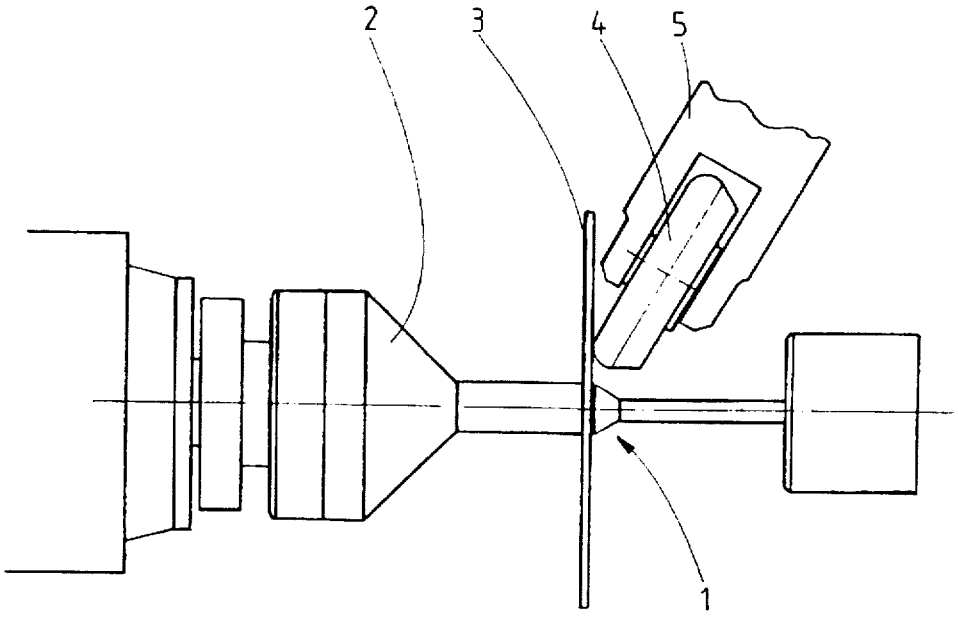
FIG. 1 is a schematic plan view illustrating a part of an embodiment of the apparatus according to the invention.
Figure 3:
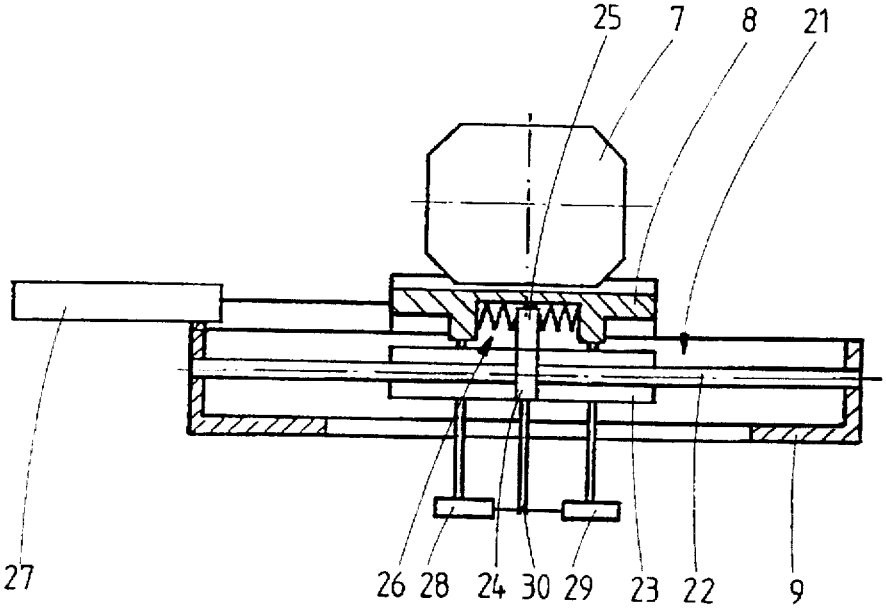
FIG. 3 is a partial sectional view along the line III—III of FIG. 2.
Figure 2:
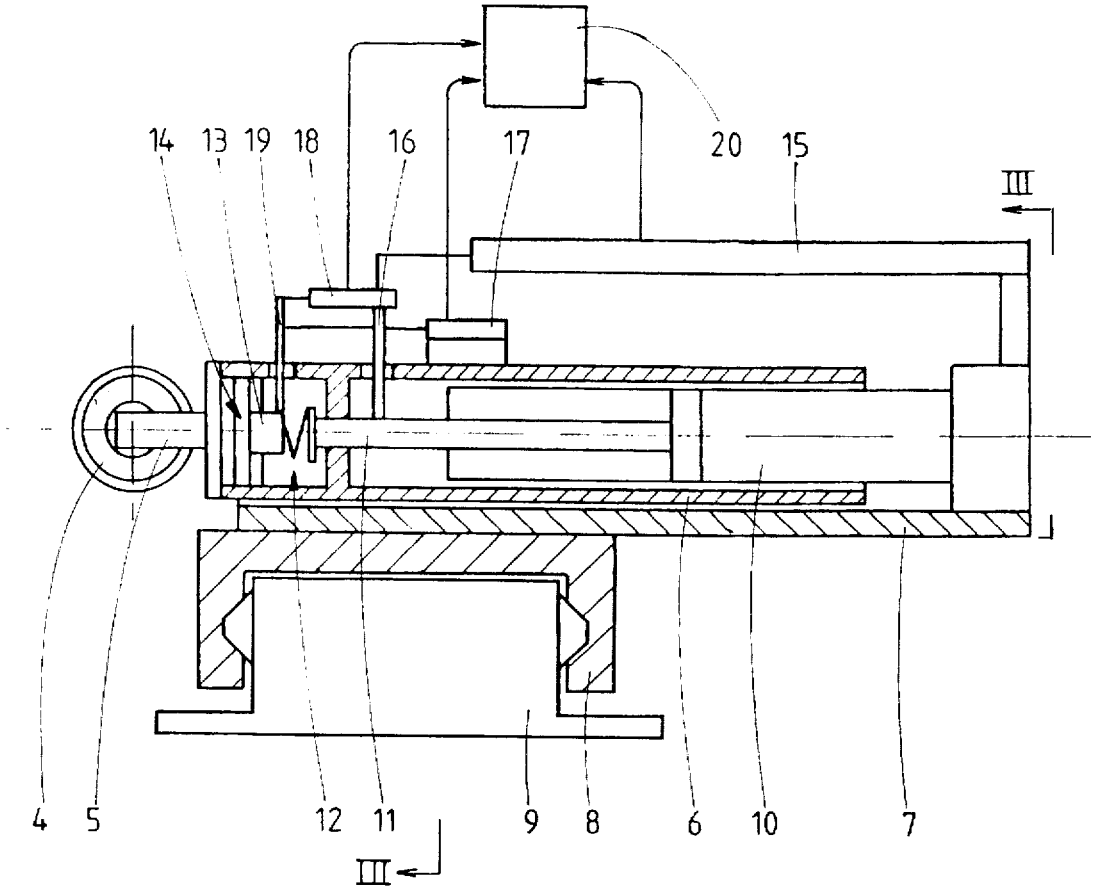
FIG. 2 is a partial schematic sectional view of the apparatus of FIG. 1.

Now referring to the drawing, FIG. 1 schematically shows a plan view of a part of the exemplary embodiment of the apparatus for spinning the metal sheet, which apparatus comprises a rotatable drivable fixture 1 in which a chuck 2 is provided. A disk-like metal sheet 3 is clamped against the chuck 2 in a conventional manner. The metal sheet 3 has to be deformed into a desired product, such as e.g. a lamp reflector, an expansion vessel or the like, on the chuck 2 by means of a forming roller 4 which is rotatably journalled in a holder 5. For this purpose, the forming roller 4 should follow a pre-determined path of movement and therefore the holder 5 should be supported by a slide assembly which can be constructed in accordance with European patent application 0 125 720 of the same applicant, as mentioned above and the contents of which are incorporated herein by reference thereto. By means of this slide assembly, the forming roller 4 is permitted to be moved both parallel to the axis of the chuck 2 and in a transverse direction. FIG. 2 shows the slide assembly very schematically in a view sectioned in the direction of movement of a upper slide 6 which is movably guided on an upper bed 7 which is fixed to an upper slide 8 which is guided movable to-and-fro on a lower bed 9. FIG. 3 shows the slide assembly in a very schematic sectional view along the line III—III of FIG. 2.

The holder 5 of the forming roller 4 is attached to one end of the upper slide 6 which, together with the forming roller 4, is displaceable by a first driving member 10 constructed as a cylinder piston unit in the exemplary embodiment as shown. A piston rod 11 of the driving member 10 drives the upper slide 6 through a spring means 12 constructed in this case as a mechanical spring but which may also be constructed as an hydraulic spring or another type of spring means. This spring means 12 has its side facing away from the piston rod 11 supported on a piston rod 13 of a cylinder piston unit 14 which is operative as adjusting member for adjusting the initial spring force of the spring means 12.

The apparatus further comprises a position detector 15 measuring the position of the piston rod 11 of the driving member 10 relative to the upper bed 7. For this purpose, a connection pin 16 is attached to the piston rod 11, said connection pin carrying a transmitting element of the position detector 15 not further shown. A second position detector 17 is mounted on the upper slide 6 and measures the position of the piston rod 11 relative to the upper slide 6. The connection pin 16 carries for this purpose a transmitting element (not shown) of the position detector 17. A third position detector 18 is supported by the connection pin 16 and measures the position of the piston rod 13 relative to the piston rod 11. For this purpose, the piston rod 13 comprises a connection pin 19, carrying a transmitting element of the position detector 18. The measuring data of the position detectors 15, 17, 18 are supplied to a control unit 20, including, in a usual manner, a memory in which the measuring data can be stored.

FIG. 3 shows that the lower slide 8 is driven by a second driving member 21 constructed as cylinder piston unit of which a piston rod 22 is fixedly mounted in the lower bed 9 and of which a cylinder 23, in which a piston 24 attached on the piston rod 22 is received, is reciprocatingly movable relative to the piston rod 22. The cylinder 23 carries a driving element 25 which is coupled to the lower slide 8 by means of a spring means 26. In the embodiment shown, the spring means 26 consists mechanical springs positioned on either side of the driving element 25, but also other embodiments are conceivable. The lower bed 9 carries a position detector 27 of which a transmitting element (not shown) is coupled to the lower slide 8 so that the position detector 27 measures the position of the lower slide. Furthermore, two position detectors 28 and 29 are provided which measure the compression of the spring means 26 in a first and a second direction, respectively. For this purpose, the cylinder 23 includes a connection pin 30 carrying the transmitting elements (not shown) of the position detectors 28, 29.

It is noted that there may be provided means in the lower slide 8 corresponding to the adjusting member 14 for adjusting the initial spring force of the spring means 26 in a manner similar to that of the spring means 12.

The position detectors 27–29 are also connected to the control unit 20. The method according to the invention and with use of the apparatus as shown and described is as follows:

In a teaching phase, the metal sheet 3 is spun against the chuck 2 on a basis of force control in a usual manner as described e.g. in the above-mentioned European patent application 0 125 720. The advantage of spinning the metal sheet 3 by force control is that the internal dimensions of the metal sheet may be adapted to the shape of the chuck 2 with very tight tolerances. The control unit 20 may adjust the first spring means 12 to a desired spring pre-stress or initial spring force by means of the adjusting member 14, in which the displacement of the piston rod 13 relative to the piston rod 11 is measured by the position detector 18. The force exerted by the forming roller 4 during the spinning operation may be derived from the compression of the spring means 12 by means of the measuring data of the position detector 17. During this teaching phase, the measuring data of the position detector 15 are stored in the memory of the control unit 20. The measuring data corresponds to the position of the piston rod 11 of the first driving member 10 relative to the upper bed 7. With the use of the measuring data of the position detector 15 and 17, the control unit 20 may affect the spinning operation using force control, in which the desired force is obtained by bringing the upper slide 6 in a corresponding position, as is further described in the above mentioned European patent application 0 125 720. From the additional measuring data of the position detector 15 and the measuring data of the position detectors 17 and 18, the control unit 20 is able to determine also the actual position of the forming roller 4 in a simple manner so that a position control is possible as well. When the product to be made must have very accurate external dimensions along the axial length, the control unit 20 controls the movement of the forming roller 4 in a last spinning movement alongside the chuck 2 by using the position values of the forming roller 4 derived form the measuring data, in which the spring means 12 is made inoperative. As a result, the forming roller 4 may not deflect against the action of the spring means 12 so that also the external dimensions of the product are able to meet very tight tolerances. When the product is produced in the teaching phase and meets the requirements, the production phase is used to form each metal sheet 3 by the control unit 20 using position control by means of the position values determined from the measuring data of the teaching phase.

It is noted that in the exemplary embodiment as described, the spring means 12 is made inoperative by fully compressing the spring means 12 by means of the adjusting member 14. However, it is also possible to compress the spring means 12 by the adjusting member 14 to such an extent that the pressure force is sufficiently high to obtain a rigid connection in normal operation but which permits limited deflection of the forming roller 4 in case of unforeseen circumstances or a calamity. Finally it is noted that the spring means 12 may also be made inoperative in another way, e.g. by switching on a mechanical coupling between the piston rod 11 and the upper slide 6.

Depending upon the shape of the chuck or the product to be made, respectively, the control unit 20 may be switched between force control and position control during the spinning operation. Position control is preferably used in those parts of the shape extending substantially axially, whereas force control is preferred in sections extending more or less radially.

According to a very favorable embodiment the position values for the forming roller 4 determined by the control unit 20 from the measuring data of the position detector 15, 17 and 18 by means of a path followed by the forming roller 4 in the last spinning step is shown on a display for the user of the apparatus, so that the user may check by means of the graphically illustrated path whether this path corresponds to the desired external shape of the product. If an observation of the screen shows that the path does not fully meet the requirements or needs a correction for another reason, the user may adjust desired position values by means of suitable input means, such as a keyboard or the like, so as to adapt the path of the forming roller.

Although the position detector 18 in the embodiment as described is used for determining the additional measuring data by means of which the control unit 20 is able to determine the position values of the forming roller 4 when the spring means 12 is switched off, it is also possible to use a position detector which measures the position values of the forming roller 4 directly to effect the position control.

It will be clear that the control of the lower slide 8 by the control unit 20 may take place in a similar manner. A position control with the aid of the measuring data of the position detector 27 is also possible, whereas a force control is possible by using the measuring data of the position detectors 28 and 29. Adjusting a pre-stress is possible again by pre-stressing the spring means 26 by means of a suitable adjusting member such as for example the adjusting member 14. These adjusting members may also be used for switching off the spring means 26, but it is of course also possible to make a fixed mechanical coupling between the driving element 25 and the lower slide 8.

It is noted that the apparatus as described comprises one forming roller having a corresponding slide assembly. It is of course also conceivable to equip the apparatus with several forming rollers and slide assemblies.

The invention is not restricted to the embodiment described herein before by way of example, which may be varied in different manners within the scope of the claims.

I claim:

1. A method of spinning a metal sheet around a chuck for forming a product, comprising the steps of:

forming an initial product on the chuck in a teaching phase using only force control by rotating the chuck about the axis of rotation and by moving a forming roller at least one time along the chuck with a predetermined pressure force;

storing measuring data corresponding to the movement of the forming roller in a memory of a control unit during the step of forming an initial product;

forming further products on the chuck in a production phase by moving the forming roller under control of the control unit on the basis of said measuring data wherein the control unit determines position values of the forming roller in an axial direction and in a transverse direction relative to the chuck from the measuring data stored in the teaching phase, and wherein during said production phase the control unit controls the forming roller at least during a part of the movement of the forming roller along the chuck only by means of the position values.

2. The method according to claim 1, wherein each of the steps of forming includes moving the roller along the chuck in two directions of movement by means of lower and upper slides, the forming roller being coupled to a driving member of the upper slide by spring means and wherein the step of forming further products includes a step of rendering the spring means at least partially inoperative by the control unit.

3. The method according to claim 2, wherein said spring means is constructed as a mechanical pressure spring and wherein the step of rendering the spring means inoperative is effected by fully compressing said mechanical pressure spring.

4. The method according to claim 2, wherein said upper slide comprises a bed coupled to a driving member of the lower slide by a second spring means which is operative in to opposite directions of movement and wherein the step of forming further products includes a step of rendering the second spring means at least partially inoperative by the control unit.

5. The method according to claim 4, wherein said second spring means is constructed as a second mechanical pressure spring and wherein the step of rendering the second spring means inoperative is effected by compressing said second mechanical pressure spring.

6. The method according to claim 1, and further comprising the steps of determining from the measuring data obtained during the teaching phase a path of the forming roller with the metal sheet abutting the chuck, storing the path in the memory, displaying the path graphically, and changing the path stored in the memory by means of an input means, whereafter, in the production phase, the forming roller is controlled according to the changed path.

7. The method according to claim 1, wherein, the step of forming further products includes controlling, the forming roller partly by force control, and partly by position control, wherein the position control is used at a part of the chuck extending substantially axially.

8. An apparatus for spinning a metal sheet comprising:

a forming roller;

an upper slide guided on an upper bed and supporting the forming roller;

a first driving member for displacing the upper slide;

a first spring coupling the forming roller to the first driving member;

a control unit having a memory and at least two detectors for determining the force exerted on the forming roller during the spinning operation, the control unit being adapted to store measuring data of the detectors into the memory during a teaching phase and to control the forming roller during a production phase with the aid of the measuring data stored in the memory; and an additional detector providing additional measuring data to the control unit, said control unit being adapted to determine position values of the forming roller from the measuring data and the additional measuring data stored in the memory and for controlling the movement of the forming roller with the aid of the thus determined position values during at least a part of the spinning operation in the production phase.

9. The apparatus according to claim 8, wherein said upper slide includes an adjusting member for adjusting the spring force of the first spring, wherein a first detector of said at least two detectors measures a position of the first driving member relative to the upper bed, a second detector of said at least two detectors measures a position of the upper slide relative to the first driving member, and the additional detector measures a position of the adjusting member relative to the first driving member, in which the control unit is adapted to determine the position of the forming roller from the measuring data from the first, second and additional detectors.

10. An apparatus according to claim 8, and further comprising:

a lower slide supporting the upper bed;

a lower bed supporting the lower slide, the lower slide being movably guided on the lower bed in a direction transverse to the direction of movement of the upper slides;

a second driving member for displacing the lower slide in two opposite directions;

a second spring coupling the lower slide to the second driving member operative in the two opposite directions; and wherein said at least two detectors measures a distance of the second spring in the two opposite directions, and the additional detector measures a position of the lower slide relative to the lower bed.

* * * * *

UNITED STATES PATENT AND TRADEMARK OFFICE

CERTIFICATE OF CORRECTION

PATENT NO. : 5,775,151

DATED : July 7, 1998

INVENTOR(S) : Massée

It is certified that error appears in the above-identified patent and that said Letters Patent is hereby corrected as shown below:

On the title page;
Attorney, Agent or Firm - replace "Koehlee" with --Koehler--

Column 6, line 6, before "and" delete ",".

Column 6, line 51, replace "slides" with --slide--.

Signed and Sealed this

Ninth Day of March, 1999

*Attest:*

Q. TODD DICKINSON

*Attesting Officer*

*Acting Commissioner of Patents and Trademarks*